United States Patent [19]

Irie

[11] Patent Number: 4,863,155

[45] Date of Patent: Sep. 5, 1989

[54] COMPACT SORTER FOR COPYING MACHINE

[75] Inventor: Yoichiro Irie, Suita, Japan

[73] Assignee: Mita Industrial Co., Ltd., Osaka, Japan

[21] Appl. No.: 186,435

[22] Filed: Apr. 26, 1988

[30] Foreign Application Priority Data

Nov. 30, 1987 [JP] Japan ..... 62-300077

[51] Int. Cl.[4] ..... B65H 39/11; B65H 31/24

[52] U.S. Cl. ..... 271/293; 271/294

[58] Field of Search ..... 271/292, 293, 294, 287

[56] References Cited

U.S. PATENT DOCUMENTS 4,580,775 4/1986 Maruyama ..... 271/293

FOREIGN PATENT DOCUMENTS 0027858 2/1982 Japan ..... 271/294

*Primary Examiner*—Andres Kashnikow
*Assistant Examiner*—Matthew C. Graham
*Attorney, Agent, or Firm*—Antonelli, Terry & Wands

[57] ABSTRACT

A sorter comprising a plurality of vertically arranged movable bin trays and a transfer mechanism for elevating and lowering the bin trays successively. Follower projecting portions, projecting in a predetermined direction, are provided respectively on the bin tray. The projecting lengths of the projecting portions increase stepwise from the bottom to the top of the bin tray arrangement. The transfer mechanism includes ring-like cams disposed opposite to the follower projecting portions so as to be free to engage the follower projecting portions and to rotate about a central axis extending in the predetermined direction and to move in the direction of the central axis, with the length of the cam extending forwardly in the direction of the central axis, progressively increasing from a given angular point in a predetermined rotating direction, and a driving unit for rotating the cam in the predetermined rotating direction, causing the cam to move forwardly in the direction of the central axis and also for rotating the cam in a reverse rotating direction by that distance rearwardly in the direction of the central axis.

4 Claims, 8 Drawing Sheets

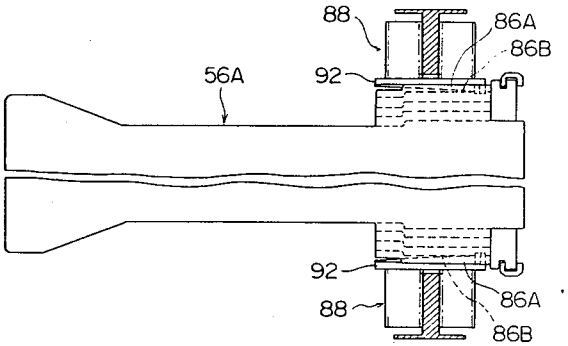
Fig. 8-B
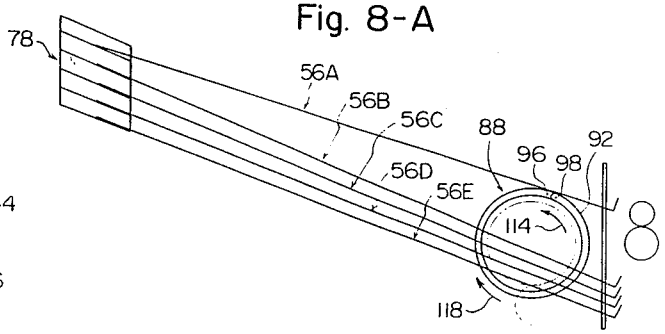
Fig. 8-A
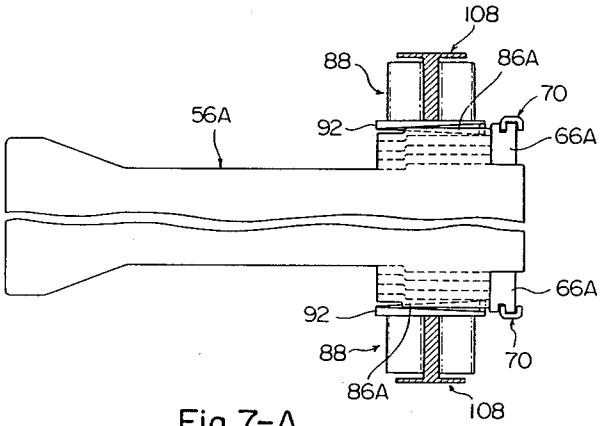
Fig. 7-B
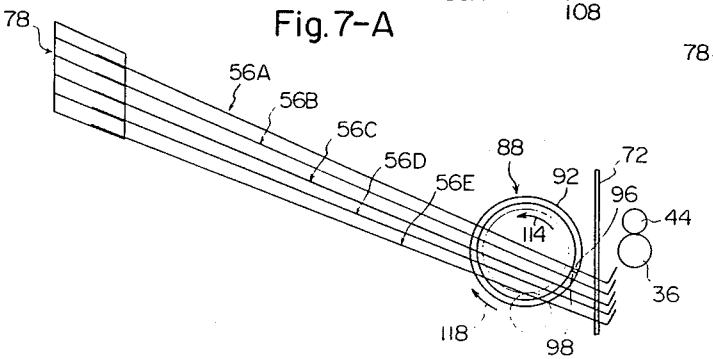
Fig. 7-A

Fig. 7-C
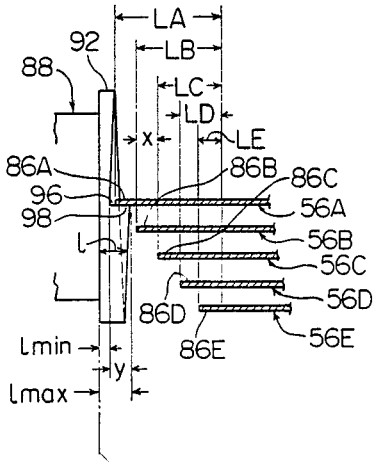
Fig. 9-C
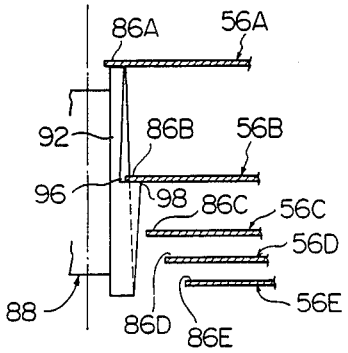
Fig. 8-C
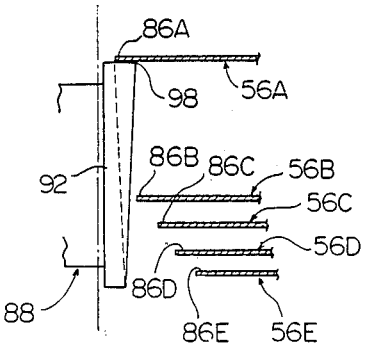
Fig. 10-C
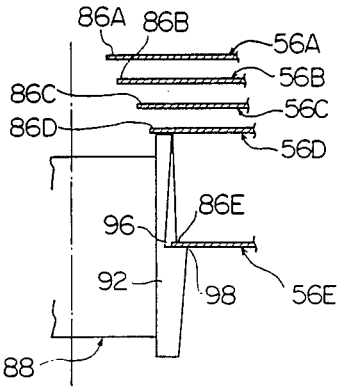

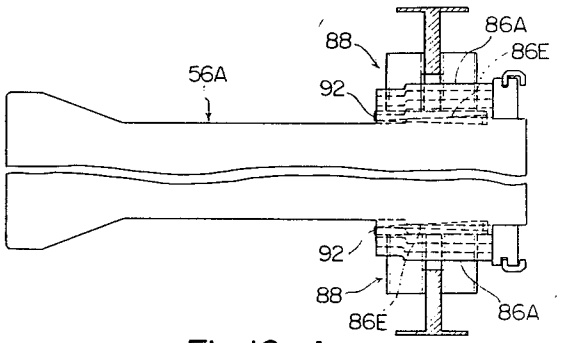
Fig. 10-B
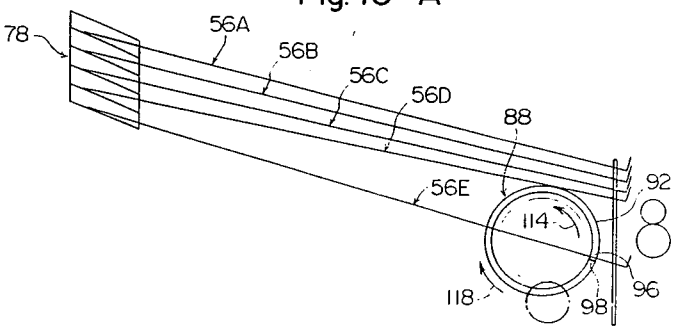
Fig. 10-A
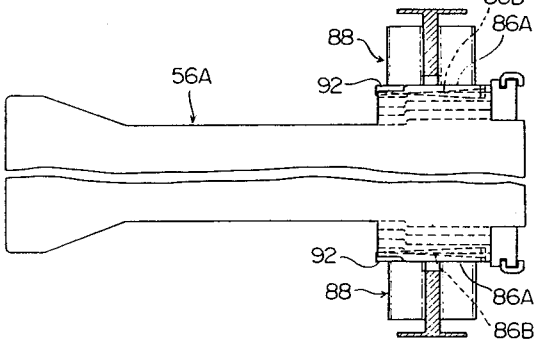
Fig. 9-B
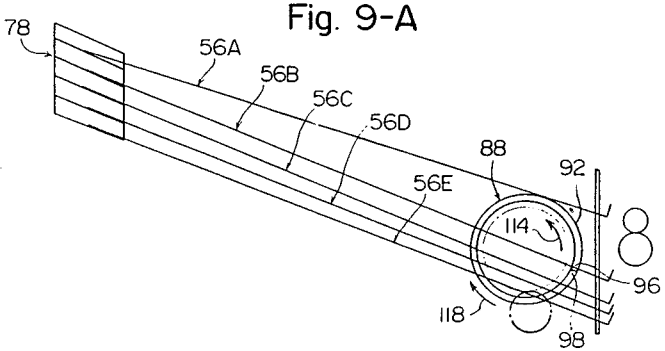
Fig. 9-A

COMPACT SORTER FOR COPYING MACHINE

FIELD OF THE INVENTION

This invention relates to a sorter for sorting sheets discharged from an image-forming machine, such as an electrostatic copying or printing machine, and collecting them.

DESCRIPTION OF THE PRIOR ART

Relatively small-sized sorters called compact sorters have been proposed and come into commercial acceptance. Typical examples of the prior art disclosing such sorters include U.S. Pat. No. 4,328,963 (Japanese Laid-Open Patent Publication No. 787703/1981), U.S. Pat. No. 4,332,377 (Japanese Laid-Open Patent Publication No. 141357/1982), U.S. Pat. No. 4,337,936 (Japanese Laid-Open Patent Publication No. 4856/1982), U.S. Pat. No. 4,343,463 (Japanese Patent Publication No. 78769/1981), U.S. Pat. No. 4,397,461, U.S. Pat. No. 4,466,608 (Japanese Laid-Open Patent Publication No. 4855/1982), U.S. Patent No. 4,466,609, and U.S. Pat. No. 4,478,406 (Japanese Laid-Open Patent Publication No. 43769/1984).

Such sorters include a plurality of vertically arranged movable bin trays and a transfer mechanism for successively elevating and lowering the bin trays. Trunnions projecting in the width direction are provided on both side surfaces of the upstream end portion (the sheet-receiving end portion) of each of the bin trays. The trunnions, which may be pins having a circular cross-sectional surface, are vertically stacked and are free to move vertically along a predetermined moving passage. The transfer mechanism acts on the trunnions of the bin trays, and elevates and lower the bin trays. A transfer mechanism of the type generally called the Geneva rotating cam-type (disclosed, for example, in U.S. Pat. No. 4,328,963 cited above) and a transfer mechanism of the type generally called the spiral rotating cam-type (disclosed for example, in U.S. Pat. No. 4,337,936 cited above) are used as such a transfer mechanism. The Geneva rotating cam-type transfer mechanism includes a Geneva disc-like cam having formed therein at least one trunnion receiving groove extending radially with an open radial outside end. The disc cam is rotated about a central axis extending in the width direction. The spiral rotating cam-type transfer mechanism includes a solid cylindrical cam having a trunnion receiving groove extending spirally on its outer circumferential surface, and the solid cylindrical cam is rotated about a vertically extending central axis.

The conventional sorters described above are considerably smaller in size and lower in price than other types of conventional sorters, but are not sufficiently simple and inexpensive for the following reasons, for example.

(a) They are required to be constructed such that when a given bin tray is elevated or lowered, the other bin trays are slightly elevated or lowered following the motion of the above bin tray, or the cam itself is slightly lowered or elevated.

(b) In order that the trunnions can be successively received in the trunnion-receiving groove of the cam, it is necessary to provide elastic biasing means for elastically biasing the trunnions with respect to the cam.

In an image-forming machine to which the sorter is to be annexed, an air discharge opening is frequently disposed immediately above a sheet discharge opening formed in one side surface of the image-forming machine. In the conventional sorter, the air discharged from the air discharge opening tends to cause inconveniences. For example, it acts on sheets within the sorter, such as sheets placed on bin trays, and makes them afloat upwardly.

SUMMARY OF THE INVENTION

It is a principal object of this invention to provide a novel and excellent sorter which is simpler in structure and can be made at a lower cost than the aforesaid conventional sorters.

An additional object of this invention is to provide a novel and excellent sorter by which even when a sheet discharge opening and an air discharge opening positioned immediately above it are formed in one side surface of an image-forming machine to which the sorter is to be annexed, the air discharged from the air discharge opening can be fully prevented from acting on sheets in the sorter.

According to this invention, with regard to the principal object, there is provided a sorter comprising a plurality of vertically arranged movable bin trays and a transfer mechanism for elevating and lowering the bin trays successively, characterized in that follower projecting portions projecting in a predetermined direction are provided respectively in the bin trays, and the projecting lengths of the projecting portions are larger stepwise from the bottom to the top of the bin tray arrangement, and the transfer mechanism includes a ring-like cam disposed opposite to the follower projecting portions so as to be free to rotate about a central axis extending in the predetermined direction and to move in the direction of the central axis, with its extending length forwardly in the direction of the central axis progressively increasing from a given angular part in a predetermined rotating direction, and driving means for rotating the cam in the predetermined rotating direction and moving it forwardly in the direction of the central axis and also for rotating it in a reverse rotating direction and moving it rearwardly in the direction of the central axis.

Furthermore, with regard to the additional object, the present invention provides a sorter having sheet receiving means disposed at its upstream end, the sorter adapted to be annexed to an image-forming machine of the type having disposed on one side surface a sheet discharge opening and an air discharge opening positioned above the sheet discharge opening the sheet receiving means being opposite to the sheet discharge opening, characterized in that the sorter includes a discharge air guiding plate for guiding the air from the air discharge opening rearwardly in the width direction from the upper surface of the upstream end portion of the sorter to prevent the air from the air discharge opening from acting on sheets in the sorter.

Other objects of this invention, along with its advantage, will become apparent from the following detailed description taken in conjunction with the accompanying drawings.

BRIEF DESCRIPTION OF THE DRAWINGS

FIGS. 7-A, 8-A, 9-A and 10-A are simplified side views useful for illustrating the operation of the sorter of FIG. 1.

FIGS. 7-B, 8-B, 9-B and 10-B are simplified top plan views useful for illustrating the operation of the sorter of FIG. 1.

FIGS. 7-C, 8-C, 9-C and 10-C are simplified partial sectional views useful for illustrating the operation of the sorter of FIG. 1.

DETAILED DESCRIPTION OF PREFERRED EMBODIMENTS

With reference to the accompanying drawings, the preferred embodiments of the invention will be described in detail.

Figure 1:
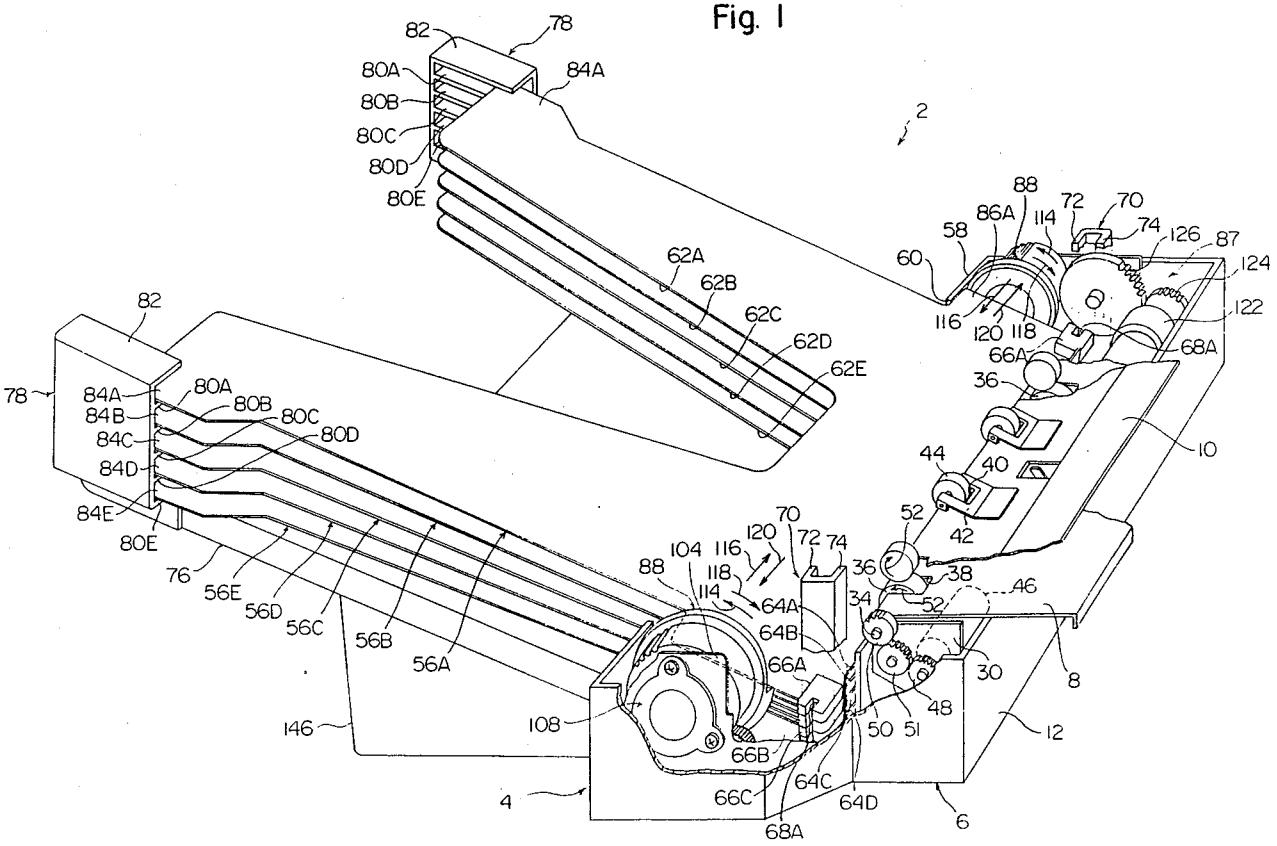
FIG. 1 is a perspective view, partly broken away, of a sorter constructed in accordance with this invention.
Figure 2:
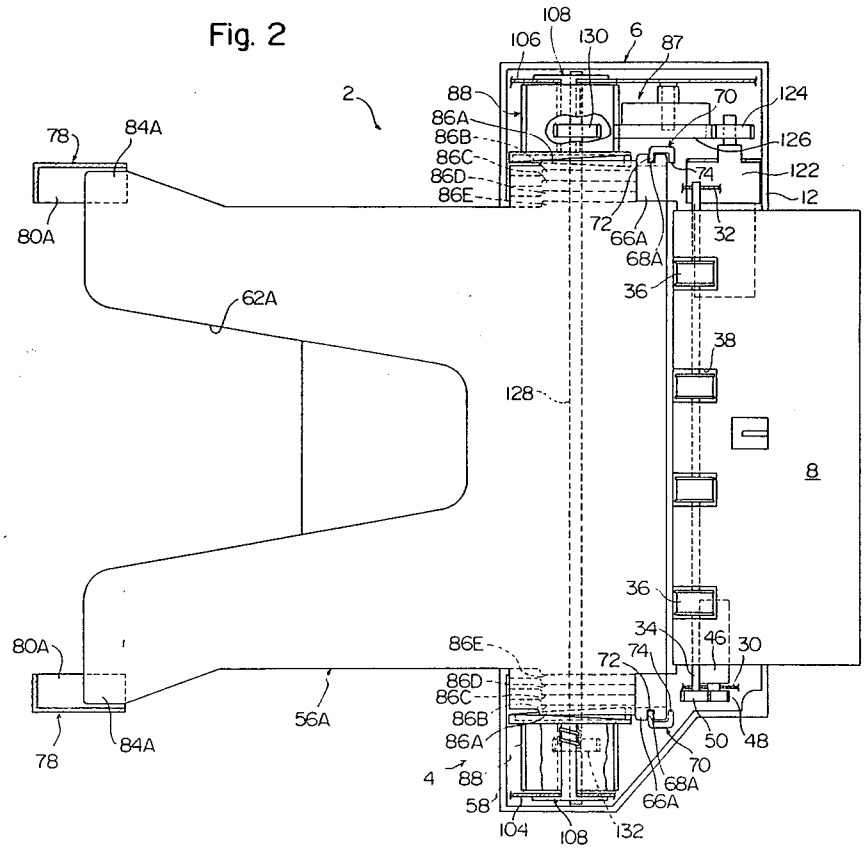
FIG. 2 is a horizontal sectional view of the sorter of FIG. 1.
Figure 3:
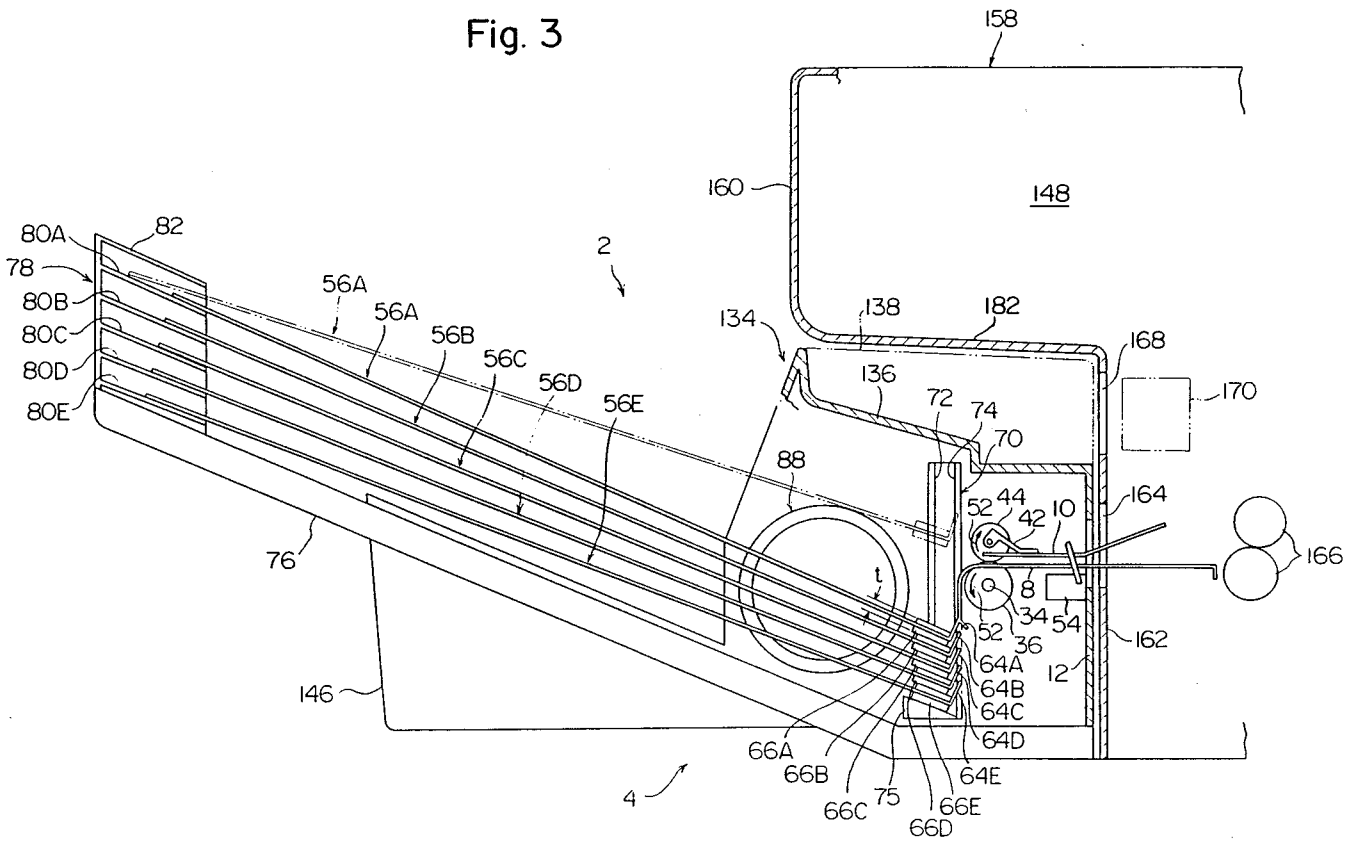
FIG. 3 is a vertical sectional view showing the sorter of FIG. 1 together with part of an image-forming machine.

With reference to FIGS. 1 and 2, the illustrated sorter shown generally at 2 is provided with a stationary supporting frame structure 4 having a box-like portion 6 with an open top. With reference to FIG. 3 taken in conjunction with FIGS. 1 and 2, a pair of guiding plates, i.e., a lower guiding plate 8 and an upper guiding plate 10, are disposed in the upstream portion (the right side portion in FIG. 3) of the box-like portion 6. The main part of the lower guiding plate 8 extends substantially horizontally along the top of the box-like portion 6, and its upstream part projects upstream beyond an upstream end wall 12. The lower guiding plate 8 may be fixed to the upstream end wall 12 of the box-like portion 6 by suitable means (not shown). The upstream portion of the upper guiding plate 10 extends upstream in a slightly upwardly inclined fashion. The upper guiding plate 10 can be fixed to a given position by linking downwardly extending places (not shown) extending downwardly from its front side edge and rear edge to the lower guiding plate 8.

Supporting members 30 and 32 spaced from each other in the front-rear direction, (the vertical direction in FIG. 2 and the direction perpendicular to the sheet surface in FIG. 3) are provided in the upstream portion of the box-like portion 6 in the supporting frame structure 4. A supporting shaft 34, extending substantially horizontally in the front-rear direction, is rotatably mounted across the supporting members 30 and 32. A plurality of (four in the drawings) rollers 36 spaced from each other in the front-rear direction are fixed to the supporting shaft 34. As can be easily appreciated by reference to FIGS. 1 and 2, a plurality of (four in the drawings) notches 38 are formed in the downstream end portion of the lower guiding plate 8 in spaced-apart relationship in the front-rear direction. The rollers 36 extend through the notches 38 and project upwardly beyond the lower guiding plate 8. As depicted in FIG. 1, a plurality of (four in the drawings) notches 40 are formed in the downstream end portion of the upper guiding plate 10 in spaced-apart relationship in the front-rear direction so that they correspond to the notches 38 in the lower guiding plate 8. Having regards the notches 40 respectively, supporting pieces 42 formed of a plate spring material are disposed on the upper surface of the upper guiding plate 10. Each of th supporting pieces 42 has a base portion fixed to the upper surface of the upper guiding plate 10, by using an adhesive or otherwise, and a bifurcating supporting portion extending downstream from the base portion in a slightly upwardly inclined fashion. A follower roller 44 is rotatably mounted on each bifurcating supporting portion. The rollers 44 extend respectively through the notches 40, project downwardly beyond the upper guiding plate 10, and by their own elastic action, are elastically pressed against the rollers 36. As shown in FIGS. 1 and 2, a driving source 46, which may be an electric motor, is mounted on the supporting member 30, and a gear 48 is fixed to the output shaft of the driving source 46. A gear 50 is also fixedly secured to the front end portion of the supporting shaft 34 to which the rollers 36 are fixed. The gear 50 is linked to the gear 48 via a gear 51 (FIG. 1) rotatably mounted on the supporting member 30. Thus, when the driving source 46 is energized, the supporting shaft 34 rotates in the direction shown by an arrow 52 (FIG. 3) to rotate the rollers 36 and 44 in the direction shown by the arrows 52 (FIG. 3). As is clearly depicted in FIG. 3, a detector 54 for detecting a sheet conveyed between the lower guiding plate 8 and the upper guiding plate 10, which may be a microswitch, is disposed in the upstream portion of the box-like portion 6 of the supporting frame structure 4.

With reference to FIGS. 1 to 3, the sorter 2 is provided with a plurality of (five in the drawings) vertically arranged bin trays 56A to 56E. Each of the bin trays 56A to 56E may be of a nearly rectangular plate-like form. The upstream end portion of each of these bin trays 56A to 56E is received in the box-like portion 6 of the supporting frame structure 4. Each of the bin trays 56A to 56E extends downstream through a large notch 60 (see FIG. 1) formed in the downstream end wall 58 of the box-like portion 6. As is clearly shown in FIG. 3, each of the bin trays 56A to 56E extends downstream in an upwardly inclined fashion. Trapezoidal relatively large notches 62A to 62E extending through a central portion in the width direction to its downstream end are formed in the downstream halves of the bin trays 56A to 56E extending from the box-like portion 6. As shown in FIGS. 1 and 3, a plurality of upwardly extending projecting pieces 64A to 64E are formed in spaced-apart relationship in the width direction in the upstream end edges of the bin trays 56A to 56E, respectively. Nearly parallelpipedal guide stacking blocks 66A to 66E are fixed to both sides in the width direction, i.e. the front and rear sides, of the upstream end edges of the bin trays 56A to 56E respectively. The thickness t (FIG. 3) of each of the blocks 66A to 66E is prescribed at a predetermined value which is considerably larger than the thickness of each of the bin trays 56A to 56E. The blocks 66A to 66E project outwardly in the width direction from the bin trays 56A to 56E, and guide notches 68A to 68E. which may be nearly rectangular, are formed in these widthwise projecting end portions. On the other hand, front and rear guiding means 70, spaced from each other in the front-rear direction, are disposed in the box-like portion 6 of the supporting frame structure 4. The front and rear guiding means 70 have a channel-like cross-sectional shape with two leg portions 72 and 74 projecting inwardly in the width direction, and extend substantially vertically. The blocks 66A to 66E fixed to the bin trays 56A to 56E respectively bring the guide notches 68A to 68E into engagement with the leg portion 72 of the guiding means 70, and are thus stacked so as to be free to move substantially vertically along the leg portion 72 of the guiding means 70. As shown in FIG. 3, a receiving stand 75 having an upper surface inclined upwardly in the downstream direction is provided in the lower end portion of the guiding means 70. The block 66E of the lowermost bin tray 56E is placed on the receiving stand 75. The blocks 66D, 66C, 66B and 66A of the second and subsequent bin trays 56D, 56C, 56B and 56A from the bottom are successively stacked on the block 66E of the lowermost bin tray 56E. In the state where the blocks 66A to 66E are stacked (the state shown in FIG. 3 by a solid line), the upstream ends of the bin trays 56A to 56E are spaced from each other vertically by a predetermined distance defined by the thickness t of each of the blocks 66A to 66E. In the illustrated embodiment, the lowermost bin tray 56E is movably coupled at its upstream end portion with the guiding means 70 via the block 66E as are the other bin trays 56A to 56D. As will be made clear from the description hereinbelow, it is not always necessary to elevate and lower the lowermost bin tray 56E. If desired, therefore, the lowermost bin tray 56E may be fixed in position.

It is appreciated by reference to FIGS. 1 and 3 that the stationary supporting frame structure 4 includes projecting portions 76 extending upwardly inclinedly at a given inclination angle from the lower end portion of the box-like portion 6 in the downstream direction in its front and rear end portions respectively in the width direction. Supporting frame portions 78 extending upwardly are formed in the downstream end parts of the projecting portions 76. Each of the supporting frame portions 78 has a top wall 82 and a plurality of (five in the drawings) supporting walls 80A to 80E spaced from each other vertically and extending inclinedly at the given inclination angle substantially parallel to each other. On the other hand, as is clearly depicted in FIGS. 1 and 2, widthwise projecting support portions 84A to 84E are formed respectively in both sides in the width direction (i.e., the front and rear sides) of the downstream end portions of the bin trays 56A to 56E. The support portions 84A to 84E of the bin trays 56A to 56E are placed respectively on the supporting walls 80A to 80E of the supporting frame portion 78, whereby the downstream end portions of the bin trays 56A to 56E are supported by the supporting frame portions 78. As will be described hereinafter, when the upstream portions of the bin trays 56A to 56E are elevated or lowered, the support portions 84A to 84E of the bin trays 56A to 56E are moved longitudinally, and pivoted slightly, with respect to the supporting walls 80A to 80E.

Widthwise outwardly projecting follower projecting portions 86A to 86E are formed in both sides in the width direction (i.e., the front and rear sides) of the upstream end portions (more specifically, immediately downstream of the guide blocks 66A to 66E) of the bin trays 56A to 56E, respectively. It will be clearly understood by reference to FIG. 7-C that the widthwise projecting lengths LA to LE of the follower projecting portions 86A to 86E formed in the bin trays 56A to 56E are prescribed at values stepwise larger by a length x from the bottom to the top of the bin tray arrangement, namely $LA=LB+x$, $LB=LC+x$, $LC=LD+x$, and $LD=LE+x$.

Figure 4:
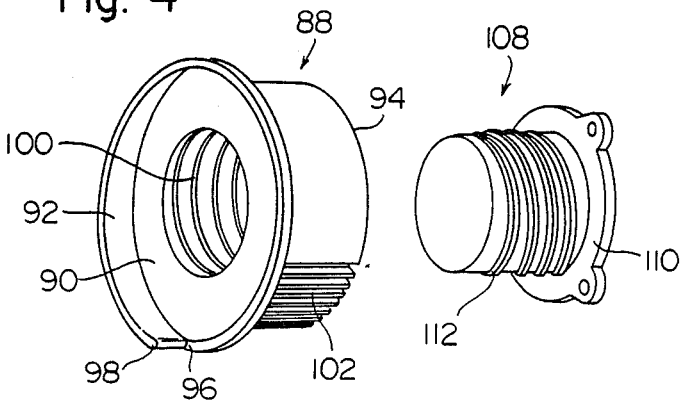
FIG. 4 is an exploded partial perspective view showing a cam member and an externally threaded rod used in the sorter of FIG. 1.

The sorter 2 constructed in accordance with this invention is also provided with a transfer mechanism shown generally at 87 which acts on the follower projecting portions 86A to 86E of the bin tray 56A to 56E and elevates or lowers the bin trays 56A to 56E successively. The transfer mechanism 87 comprises a front cam member 88, disposed opposite to, and forwardly of, the follower projecting portions 86A to 86E formed in the front sides of the trays 56A to 56E, and a rear cam member 88, disposed opposite to, and rearwardly of, the follower projecting portions 86A to 86E formed in the rear sides of the bin trays 56A to 56E. With reference to FIG. 4, each of the front and rear cam members 88 is comprised of an annular plate portion 90, a ring-like cam 92 formed in the inside surface in the width direction of the annular plate portion 90 and a cylindrical portion 94 formed in the outside surface in the width direction of the annular plate portion 90. The ring-like cam 92 extends inwardly in the width direction of the annular plate portion 90. The ring-like cam 92 extends widthwise inwardly from the inside surface of the annular plate portion 90, and its extending length l progressively increases from its minimum value $l_{min}$ at a given angular point 96 in a predetermined rotating direction (as shown in FIG. 4, counterclockwise toward the cam 92 in the case of the cam 92 of the rear cam member 88, and clockwise toward the cam 92 in the case of the cam 92 of the front cam member 88) to its maximum value $l_{max}$ at an angular point 98 substantially 360° displaced from the aforesaid given angular point 96 (see FIG. 7-C). The difference y between the maximum value and the minimum value ($y=l_{max}-l_{min}$) is prescribed substantially at the same value as the predetermined length x defined with regard to the follower projecting portions 86A to 86E (the difference of the projecting lengths of the vertically adjoining follower projecting portions). The cylindrical portion 94 extends widthwise outwardly from the outside surface of the annular plate portion 90 and is disposed concentrically with the ring-like cam 92. An internal thread 100 is formed in the inner circumferential surface of the cylindrical portion 94. A gear 102 is formed on the outer circumferential surface of the cylindrical portion 94.

With reference to FIGS. 1, 2 and 4, an upstanding supporting member 104, disposed in the foremost part in the width direction, and an upstanding supporting member 106 disposed in the rearmost part in the width direction are provided in the box-like portion 6 of the supporting frame structure 4. A stationary front externally threaded rod 108 is fixed to the supporting member 104 and a stationary rear externally threaded rod 108 is fixed to the supporting member 106. As is clearly shown in FIG. 4, the externally threaded rod 108 has a linking flange 110 and a main portion 112 with an external thread formed in its outer circumferential surface. The linking flange 110 is fixed to the supporting member 104 or 106 and the main portion 112 extends substantially horizontally and widthwise inwardly through an opening formed in the supporting member 104 or 106. As shown in FIGS. 1 and 2, the external threads on the rods 108 to which the cylindrical portions 94 of the front and rear cam members 88 are secured, and the internal threads formed in the cylindrical portions 94 are designed such that when the cam member 88 is rotated through one turn, as will be described hereinafter, the cam member 88 moves forwardly (moves inwardly in the width direction) in the direction of its central axis by a distance equal to y (the difference between the maximum value $l_{max}$ and the minimum value $l_{min}$ in the cam 92) or moves rearwardly (moves outwardly in the width direction) by that distance. The internal thread in the rear cam member 88 and the external thread in the rear externally threaded rod 108 shown in FIG. 4 are formed in the same directions as in ordinary threads, whereas the internal thread formed in the front cam member 88 and the external thread formed in the front externally threaded rod 108 are formed in opposite directions to ordinary threads. Hence, when the rear cam member 88 is rotated in the direction shown by an arrow 114 in FIG. 1, it is advanced widthwise inwardly in the direction shown by an arrow 116. When it is rotated reversely as shown by an arrow 118, it is moved backward and widthwise outwardly as shown by an arrow 120 in FIG. 1.

Figure 5:
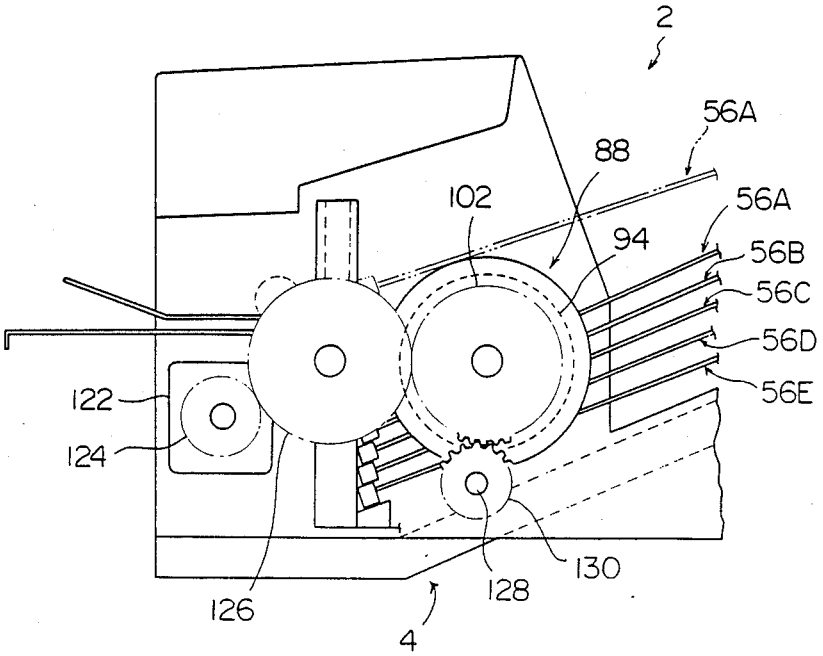
FIG. 5 is a partial vertical sectional view showing the method of driving a transfer mechanism in the sorter of FIG. 1.

With reference to FIG. 5 taken in conjunction with FIGS. 1 and 2, a driving source 122, which may be an electric motor, is also disposed in the box-like portion 6 of the supporting frame structure 4. A gear 124 is fixed to the output shaft of the driving source 122. The gear 124 is linked to the gear 102 formed on the outer circumferential surface of the cylindrical portion 94 of the rear cam member 88 via a gear 126 rotatably mounted on the upstanding supporting member 106. A shaft 128, extending substantially horizontally beneath the lowermost bin tray 56E, is rotatably mounted across the upstanding supporting members 104 and 106. To the rear end portion of the shaft 128 is fixed a gear 130 kept in mesh with the gear 102 of the rear cam member 88, and a gear 132 kept in mesh with the gear 102 of the front cam member 88 is fixed to the front end portion of the shaft 128. When the driving source 122 is rotated in the normal direction, the rear cam member 88 is rotated in the direction of arrow 114 via the gears 124 and 126, and the front cam member 88 is rotated in the direction of arrow 114 in synchronism with the rear cam member 88 via the shafts 128 and the gear 132. When the driving source 122 is rotated in the reverse direction, the rear cam member 88 and the front cam member 88 are synchronously rotated in the direction of arrow 118.

Figure 6:
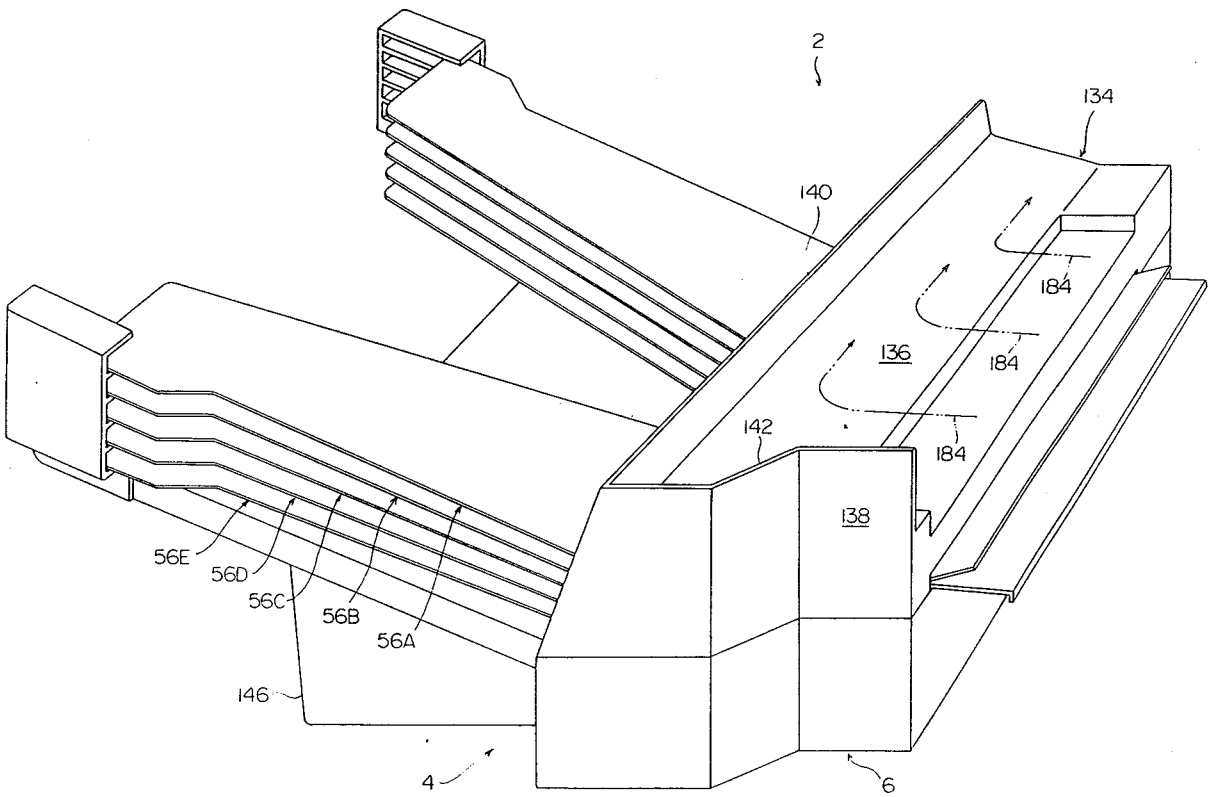
FIG. 6 is a perspective view of the sorter of FIG. 1.

With reference to FIG. 6 taken in conjunction with FIGS. 1 and 3, the supporting frame structure 4 in the illustrated embodiment also includes a cover member 134 to be removably put over the box-like portion 6. It should be noted in regard to this cover member 134 that its upper wall 136 extends downstream from its upstream end in a nearly horizontally and slightly upwardly inclined fashion, and then near its downstream end, extends upwardly at a large inclination angle. It should further be noted that the front wall 138 of the cover member 134 projects upwardly beyond the upper wall 136 and the upper edge 142 of the front wall 138 and the upwardly directed downstream edge 140 of the upper wall 136 are set at the same height. As will be described hereinafter, the upper wall 136 and the front wall 138 of the cover member 134 constitute a discharged air guiding plate for guiding the air, discharged from the image-forming machine to which the sorter 2 is annexed, rearwardly in the width direction from the upper surface of the upstream end portion of the sorter and preventing the discharged air from advancing into the sorter 2 and thus acting on sheets.

The illustrated supporting frame structure 4 also includes a hollow box portion 146 positioned downstream of the box-like portion 6 and below the projecting portion 76. The hollow box portion 146 is adapted to receive control means (not shown) for controlling the action of the driving sources 46 and 122 and thus the action of the sorter 2. The driving sources 46 and 122 may be controlled, for example, on the basis of the detection of a sheet by the detector 54 (FIG. 3).

The operation of the sorter 2 described above will be described. As shown in FIG. 3, the sorter 2 is used in combination with an image-forming machine 148 such as an electrostatic copying machine. The image-forming machine 148, whose left side portion alone is illustrated in a simplified manner, has a housing 158. The left side portion of the housing 158 has a projecting upper part and a retracted lower part. Hence, the left side surface of the housing 158 has a projecting upper left side surface 160 and a retracted lower left side surface 162. A sheet discharge opening 164 is disposed nearly midway in the lower left side surface 162 in its vertical direction. A pair of discharge rollers 166 are disposed upwardly of the sheet discharge opening 164 within the housing 158. An air discharge opening 168 above the sheet discharge opening 164 is also formed in the lower left side surface 162. Within the housing 158 is further provided a blower 170 for discharging the air in the housing 158 through the air discharge opening 168.

As shown in FIG. 3, the box-like portion 6 and the cover member 134 over it in the supporting frame structure 4 of the sorter 2 are inserted into the lower part of the projecting upper portion of the image-forming machine 148, thereby to combine the sorter 2 with the image-forming machine 148. Thus, the projecting portions of the pair of guiding plates 8 and 10 advance into the housing 158 via the sheet discharge opening 164 and are positioned opposite to the rollers 166. A sheet conveyed to the left in FIG. 3 by the discharge rollers 166 of the image-forming machine 148 advances between the pair of guiding plates 8 and 10 of the sorter and is introduced into the sorter while being guided by these guiding plates. As shown in FIG. 3, the upper wall 136 of the cover member 134 extends downstream from its upstream end located immediately below the air discharge opening 168, while being in proximity to the lower left side surface 162 of the housing 158. The upwardly directed downstream end portion of the upper wall 136 extends to a site near the lower end of the upper left side surface 160 of the housing 158. It will be appreciated by reference to FIGS. 3 and 6 that the upper edge 142 of the front wall 138 of the cover member 134 is positioned in proximity to the upper left side surface 160 or the upper lower surface 182 of the housing 158. Because of this arrangement, the air discharged from the housing 158 via the air discharge opening 168, by the action of the blower 170, flows downstream over the top wall 136 of the cover member 134 and then rearwardly in the width direction, and is thus conducted rearwardly of the sorter 2. Consequently, inconveniences ascribed to the discharged air can be prevented. For example, sheets on the bin trays 56A to 56E of the sorter 2 are prevented from floating upwardly by the action of the discharged air from the discharge opening 168 upon these sheets. Furthermore, since the presence of the front wall 138 of the cover member 134 hampers the flowing of the discharged air from the discharge opening 168 forwardly of the sorter 2, the discharged air is prevented from blowing on the operator who may be present in front of the sorter 2 or the image-forming machine 148.

As stated above, a sheet conveyed to the left in FIG. 3 by the pair of discharge rollers 166 of the image-forming machine 148 is introduced into the sorter 2 by being guided between the pair of guiding plates 8 and 10, and then further conveyed to the left in FIG. 3 by the action of the rollers 36 and 44 in the sorter 2. When the bin trays 56A to 56E of the sorter 2 are at an "initial position" shown by a solid line in FIG. 3, the sheet discharged from the rollers 36 and 44 is distributed to the uppermost bin tray 56A. When the bin-trays 56A to 56E are at the initial position, the front and rear cam members 88 of the transfer mechanism 87 are at an initial position shown by FIGS. 7-A, 7-B and 7-C. At this initial position, the angular position of the cam 92 is prescribed such that its maximum projecting angular part 98 is located below, and in proximity to or in contact with, the follower projecting portion 86A of the uppermost bin tray 56A. The widthwise position of the cam 92 is prescribed such that it can engage the follower projecting portion 86A of the uppermost bin tray 56A at its maximum projecting angular portion 98 (namely, it projects widthwise inwardly of the widthwise projecting end of the follower projecting portion 86A), but cannot contact it at its minimum projecting angular part 96 (namely, it exists widthwise outwardly of the widthwise projecting end of the follower projecting portion 86A). Accordingly, the cam 92 exerts no action on the follower projecting portion 86A of the uppermost bin tray 56A.

In order that the sheet discharged from the rollers 36 and 44 may be distributed to the second bin tray 56B, the driving source 122 is rotated in a normal direction for a predetermined period of time to rotate the front and rear cam members 88 substantially through one turn in the direction of arrow 114. FIGS. 8-A, 8-B and 8-C show the states where the front and rear cam members 88 have been rotated through about 45 degrees in the direction of arrow 114 from the initial position shown in FIGS. 7-A, 7-B and 7-C. FIGS. 9-A, 9-B and 9-C show the states where the front and rear cam members 88 have been rotated substantially through one turn in the direction of arrow 114 from the initial position shown in FIGS. 7-A, 7-B and 7-C. It will be easily appreciated from these drawings that when the front and rear cam members 88 are rotated in the direction of arrow 114, the maximum projecting angular part 98 of the cam 92 first acts on the follower projecting portion 86A of the uppermost bin tray 56A, whereby incident to the rotation of the maximum projecting angular portion 98 of the cam 92, the upstream portion of the uppermost bin tray 56A is elevated to the position shown in FIGS. 8-A and 8-C. When the front and rear cam members 88 are rotated in the direction of arrow 114, they are caused to advance inwardly in the width direction because of the cooperative action of the external threads on the stationary externally-threaded rod 108 and the internal threads of the cam members 88. Accordingly, even when the cam 92 continues to rotate in the direction of arrow 114 beyond the position shown in FIGS. 8-A, 8-B and 8-C and its maximum projecting angular portion 98 moves downwardly from the follower projecting portion of the uppermost bin tray 56A, the follower projecting portion 86A of the uppermost bin tray 56A continues to be held by the outer circumferential surface of the cam 92, and therefore, the uppermost bin tray 56A continues to be kept at the elevated position shown in FIGS. 8-A and 8-C. When the front and rear cam members 88 are further rotated, the cam 92 is rotated, with its maximum projecting angular portion 98 caused to advance inwardly in the width direction to a position at which it can engage the follower projecting portion of the second bin tray 56B. Consequently, the maximum projecting angular part 98 of the cam 92 acts on the follower projecting portion 86B of the second bin tray 56B to elevate it to the position shown in FIGS. 9-A and 9-C. The height of the position of the follower projecting portion 86B of the second bin tray 56B is substantially equal to the height of the position of the follower projecting portion 86A of the uppermost bin tray 56A in FIGS. 7-A and 7-C. As can be understood from a comparison of FIG. 7-C with FIG. 9-C, the front and rear cam members 88 advance inwardly in the width direction by a distance corresponding to the aforesaid predetermined length x ($x=y=l_{max}-l_{min}$) when they have been rotated through one turn in the direction of arrow 114. Thus, the relation of the cam 92 to the follower projecting portion 86B of the second bin tray 56B in the state shown in FIGS. 9-A, 9-B and 9-C corresponds to the relation of the cam 92 to the follower projecting portion 86A of the uppermost bin tray 56A in the state shown in FIGS. 7-A, 7-B and 7-C. The upstream end portion of the uppermost bin tray 56A is elevated over a relatively large distance as described above, and the upstream end portion of the second bin tray 56B is elevated slightly. The upstream end portion of the second bin tray 56B still exists below the nipping site of the rollers 36 and 44, but the upstream end portion of the uppermost bin trays 56A exists above the nipping site of the rollers 36 and 44, as clearly shown in FIG. 9-A. Hence, the sheet discharged from the rollers 36 and 44 is distributed onto the second bin tray 56B, not onto the uppermost bin tray 56A.

By further rotating the front and rear cam members 88 in the direction of arrow 114 through one turn, the sheet discharged from the rollers 36 and 44 is distributed onto the third bin tray 56C from the top of the bin tray arrangement. In this case, the upstream end portion of the second bin tray 56B is elevated over a relatively large distance to the site at which the upstream end portion of the uppermost bin tray 56A exists in FIGS. 9-A and 9-C, in the same way as described above. When the second bin tray 56B is elevated to the above height, the guide stacked block 66B of the second bin tray 56B acts on the guide stacked block 66A of the uppermost bin tray 56A to elevate it over a distance corresponding to the aforesaid thickness t (see FIG. 3). The upstream end portion of the third bin tray 56C is also slightly elevated to a site at which the upstream end portion of the second bin tray 56B is located in FIGS. 9-A and 9-C. Thus, the upstream end portion of the third bin tray 56C exists below the nipping site of the rollers 36 and 44 but the upstream end portion of the second bin tray 56B exists above the nipping site of the rollers 36 and 44. Hence, the sheet discharged from the rollers 36 and 44 is distributed onto the third bin tray 56C.

To have the sheet from the rollers 36 and 44 distributed onto the fourth bin tray 56D from the top of the bin tray arrangement, the front and rear cam members 88 are further rotated through one turn in the direction of arrow 114. As a result, in the same way as described above, the upstream end portion of the third bin tray 56C is elevated over a relatively large distance to the position where the upstream end portion of the first bin tray 56A exists in FIGS. 9-A and 9-B. When the third bin tray 56C has been elevated to the above height, the guide stacked block 66C of the third bin tray 56C acts on the guide stacked block 66B of the second bin tray 56B to slightly elevate the upstream end portions of the first and second bin trays 56A and 56B. The upstream end portion of the fourth bin tray 56D is also slightly elevated to the position where the second bin tray 56B exists in FIGS. 9-A and 9-C. Thus, the upstream end portion of the fourth bin tray 56D still exists below the nipping site of the rollers 36 and 44 but the upstream end portion of the third bin tray 56C exists above the nipping site of the rollers 36 and 44. Hence, the sheet discharged from the rollers 36 and 44 is distributed onto the fourth bin tray 56D.

By further rotating the front and rear cam members 88 through one turn in the direction of arrow 114, the sheet discharged from the rollers 36 and 44 is distributed onto the fifth, i.e., the lowermost, bin tray 56E. In this case, the upstream end portion of the fourth bin tray 56D is elevated over a relatively large distance to the position shown in FIGS.10-A and 10-C. When the fourth bin tray 56D has been elevated to this height, the guide stacked block 66D of the fourth bin tray 56D acts on the guide stacked block 66C of the third bin tray 56C to slightly elevate the upstream end portions of the first, second and third bin trays 56A, 56B and 56C. The upstream end portion of the fifth bin tray 56E is also elevated slightly to the position shown in FIGS. 10-A and 10-C. As a result, the upstream end portion of the lowermost bin tray 56E still exists below the nipping site of the rollers 36 and 44, but the upstream end portion of the fourth bin tray 56D exists above the nipping site of the rollers 36 and 44. Hence, the sheet discharged from the rollers 36 and 44 is distributed onto the lowermost bin tray 56E.

On the other hand, when the front and rear cam members 88 are rotated in a reverse direction shown by an arrow 118 by reversing the rotation of the driving source 122, the bin trays 56A to 56E are lowered successively in quite a reverse manner to that described above. Specifically, when the front and rear cam members 88 are rotated through one turn in the direction of arrow 118 in the state shown in FIGS. 10-A, 10-B and 10-C (the state in which the sheet is distributed onto the lowermost bin tray 56E), the cam 92 is rotated in the direction of arrow 118 and simultaneously moved backward outwardly in the width direction. As a result, the lowermost bin tray 56E is slightly lowered and the fourth bin tray 56D is lowered over a relatively large distance. The sheet discharged from the rollers 36 and 44 is thus in condition for distribution onto the fourth bin tray 56D. When the front and rear cam members 88 are further rotated through one turn in the direction of arrow 118, the fourth bin tray 56D is slightly lowered and simultaneously the third bin tray 56C is lowered over a relatively large distance. Consequently, the sheet discharged from the rollers 36 and 44 is in condition for distribution onto the third bin tray 56C. When the front and rear cam members 88 are further rotated through one turn in the direction of arrow 118, the third bin tray 56C is slightly lowered and simultaneously, the second bin tray 56B is lowered over a relatively large distance. As a result, the sheet discharged from the rollers 36 and 44 is in condition for distribution onto the second bin tray 56B (the state shown in FIGS. 9-A, 9-B and 9-C). When the front and rear cam members 88 are further rotated through one turn in the direction of arrow 118, the second bin tray 56B is slightly lowered and the uppermost bin tray 56A is lowered over a relatively large distance. Consequently, the sheet discharged from the rollers 36 and 44 is in condition for distribution onto the uppermost bin tray 56A (the initial state shown in FIGS. 7-A, 7-B and 7-C).

It will be readily appreciated from a comparative study of FIGS. 7-A, 8-A, 9-A and 10-A that while the upstream end portions of the bin trays 56A to 56E are elevated, the support portions 84A to 84E, formed in the downstream end portions of these bin trays, slide downstream with respect to the supporting walls 80A to 80E of the supporting frame portion 78 and pivot counterclockwise as viewed from before. Conversely, when the upstream end portions of the bin trays 56A to 56E are lowered, the support portions 84A to 84B, formed in the downstream end portions of the bin trays 56A to 56E, slide upstream with respect to the supporting walls 80A to 80E of the supporting frame portion 78 and pivot clockwise as viewed from before.

While the present invention has been described in detail with regard to the preferred embodiments of the sorter constructed by this invention, taken in conjunction with the accompanying drawings, it should be understood that the present invention is not limited to these embodiments, and various changes and modifications are possible without departing from the scope of the invention.

For example, in the illustrated embodiments, the support portions 84A to 84E are formed in the downstream end portions of the bin trays 56A to 56E and are placed on the supporting walls 80A to 80E of the supporting frame portion 78. If desired, as disclosed in the above-cited U.S. Pat. No. 4,332,377 for example, suitable stacked blocks may be disposed in the downstream end portions of the bin trays 56A to 56E, and stacked.

Furthermore, in the illustrated embodiments, when a given bin tray (for example, the uppermost bin tray 56A) is elevated over a relatively large distance so that the sheet is adapted to be distributed onto a bin tray located immediately below it (for example, the second bin tray 56B), the bin tray immediately below it (e.g., the second bin tray 56B) is slightly elevated. This slight elevation of the lower bin tray, however, is not always necessary. If desired, the sorter may be constructed such that this slight elevation of the bin tray is not performed.

What is claimed is:

1. A sorter for an image-forming machine, said sorter comprising:

a plurality of vertically arranged movable bin trays, each bin tray including a bin tray body portion and follower projecting portions projecting in a predetermined direction from the bin tray body portions, the projecting lengths of the projecting portions increasing stepwise from the bottom bin tray to the top bin tray in the bin tray arrangement; and a transfer mechanism for elevating and lowering the bin trays successively, said transfer mechanism including at least one ring-like cam disposed opposite to the follower projecting portions so as to be free to engage the follower projecting portions and to rotate about a central axis extending in said predetermined direction and to move in the direction of said central axis, the length of said cam, extending forwardly in the direction of said central axis, progressively increasing from a given angular point in a predetermined rotating direction; and driving means for rotating said cam in said predetermined rotating direction, causing said cam to move forwardly in the direction of said central axis, and also for rotating said cam in a reverse rotating direction, causing said cam to move rearwardly in the direction of said central axis.

2. The sorter set forth in claim 1 wherein said follower projecting portions are provided on both sides of the front parts of each of the bin trays respectively, and the transfer mechanism has two of said ring-like cams disposed opposite to said both sides of the front parts of said bin trays.

3. The sorter set forth in claim 1 wherein said cam is formed as a cam member having a cylindrical portion with an internal thread formed in the inner circumferential surface thereof; the transfer mechanism includes a stationary externally threaded rod extending in the direction of said central axis; and the cylindrical portion of the cam member threadedly engages the externally threaded rod.

4. The sorter set forth in claim 1 further comprising vertically extending guiding means, and guide stacked blocks disposed on at least one side of the front end portions of the bin trays, said guide stacked blocks being adapted to ascend and descend along said guiding means.

* * * * *